US006571405B1

(12) United States Patent
Saputo et al.

(10) Patent No.: US 6,571,405 B1
(45) Date of Patent: Jun. 3, 2003

(54) LARGE CAPACITY REINFORCED SWIMMING POOL

(75) Inventors: Richard A. Saputo, Tarzana, CA (US); Hua Hsiang Lin, Kowloon (HK); Yaw-Yuan Hsu, Taipei (TW); Jia-Hua Chen, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 10/040,324

(22) Filed: Oct. 16, 2001

Related U.S. Application Data

(63) Continuation-in-part of application No. 09/400,175, filed on Sep. 21, 1999, now abandoned.

(51) Int. Cl.[7] ..... E04H 4/14
(52) U.S. Cl. ..... 4/506; 220/613
(58) Field of Search ..... 4/506, 513; 220/613, 220/678

(56) References Cited

U.S. PATENT DOCUMENTS

| | | | | |
|---|---|---|---|---|
| 1,961,061 A | | 5/1934 | McCulloch | |
| 2,529,872 A | | 11/1950 | Hasselquist | |
| 2,551,673 A | | 5/1951 | Hasselquist | |
| 2,839,762 A | | 6/1958 | Nomura | |
| 3,150,795 A | * | 9/1964 | Schlumberger | 220/678 X |
| 4,538,311 A | | 9/1985 | Hall et al. | |
| 5,416,932 A | | 5/1995 | Ventrice | |
| 5,603,129 A | | 2/1997 | Chou | |
| 5,652,972 A | | 8/1997 | Chartrand | |
| 5,736,719 A | | 4/1998 | Lawson et al. | |
| 5,815,853 A | | 10/1998 | Chase | |

* cited by examiner

*Primary Examiner*—Robert M. Fetsuga
(74) *Attorney, Agent, or Firm*—Lewis, Brisbois, Bisgaard & Smith LLP

(57) ABSTRACT

A large capacity reinforced swimming pool for use in an above-the-ground environment includes a flexible plastic liner for containing water. The liner includes a continuous sidewall and a bottom wall bonded to the sidewall by a joining seam. The continuous sidewall is formed from a partial outer layer and a partial inner layer. An inflatable top ring is mounted to the top of the sidewall for supporting the liner in an upright position. A continuous reinforcing layer is bonded to the continuous sidewall with a first plurality of continuous reinforcing seals for reinforcing the sidewall. A second plurality of continuous reinforcing seals located at an interface between the partial outer layer and the partial inner layer of the sidewall functions to reinforce the sidewall. Each of the first and second plurality of continuous reinforcing seals includes at least two seals.

14 Claims, 2 Drawing Sheets

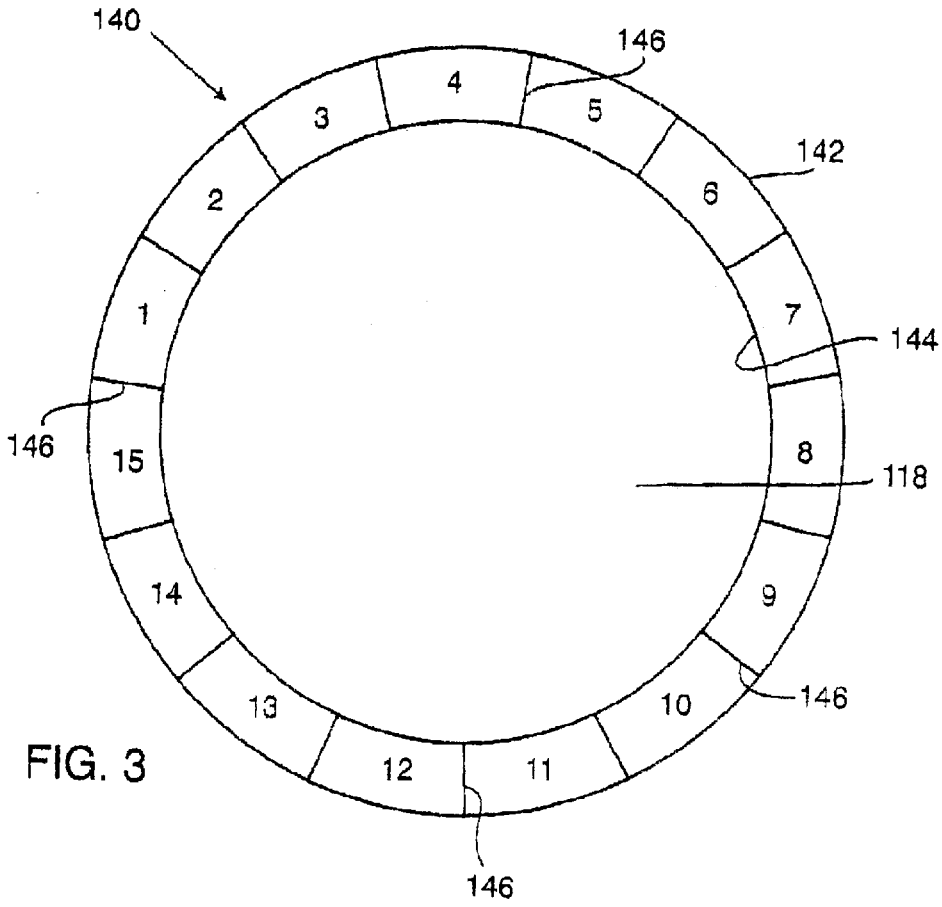
FIG. 3
FIG. 4
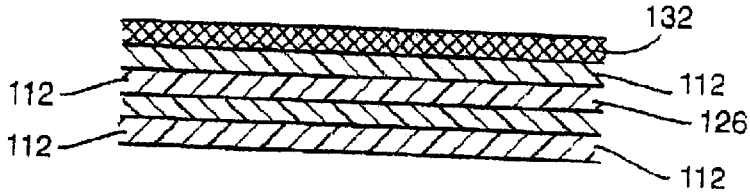
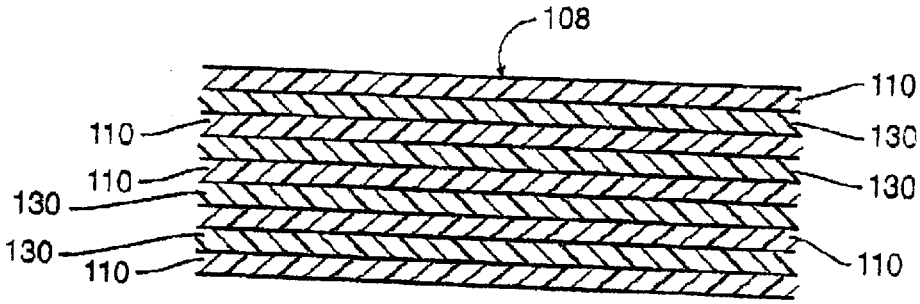
FIG. 5

LARGE CAPACITY REINFORCED SWIMMING POOL

This application is a continuation-in-part of Ser. No. 09/400,175 filed Sep. 21, 1999 now abandoned.

BACKGROUND OF THE INVENTION

1. Field of the Invention

The present invention relates to above-the-ground swimming pools. More specifically, the present invention relates to methods and apparatus for a large capacity reinforced swimming pool for use above-the-ground which includes a continuous reinforcing layer bonded to a sidewall with a first plurality of reinforcing seals and a second plurality of reinforcing seals for reinforcing the sidewall against failing due to excessive water pressure.

2. Description of the Prior Art

The prior art is directed to methods and apparatus for above-the-ground, large capacity swimming pools formed from flexible polymeric sheeting such as polyvinylchloride and typically used in the out-of-doors.

The science of dielectrically or Radio Frequency (RF) sealing polymeric or polyvinylchloride (PVC) materials of the prior art is well known in the plastics industry. The use of PVC sheeting for both in-the-ground and above-the-ground pool liners has become more popular in recent years. The initial applications of these pool liners originated with the PVC sheeting being used as pond and ditch liners. However, the uses of PVC sheeting has been expanded. As the strength of above-the-ground pool liners improved (including those supported by a skeletonal metal or plastic framework and those that were unsupported), the greater the depth of water the prior art pool liners could support. As a consequence, the resulting stress and strain on the above-the-ground prior art pool liners increased as the depth of water in the pool increased. Is it understood that if the stress and strain from the pressure created by the water in the pool exceeds a certain threshold, the seams (typically known as "joint seams") that seal the liner sections together will leak or burst. This leakage in prior art pools typically occurred in the vertical sidewall of the liner especially when the static pressure of the water was augmented by the dynamic pressure created by people moving about in the pool.

In the prior art, a method used to counter or offset the harmful effects of the excessive water pressure on the sidewall of the pool was to increase the wall thickness and thus the strength of the liner. This prior art solution applied to any polymeric or plastic material. Thus, if the pool liner was a single sheet, i.e., single-ply, of polyvinylchloride (PVC), then the PVC sheet could be calendered thicker (where calendering is the manufacturing process of producing flexible PVC sheeting). In the limit, the point of diminishing returns was reached wherein calendering a thicker or heavier PVC liner sheet was no longer cost effective.

Another common technique employed in the prior art for producing stronger polymeric or plastic wall sheets involved bonding materials together in a lamination. This type of prior art lamination method is similar to lamination methods used in producing plywood sheets for the home construction industry.

In the plywood lamination method, two or more layers of thin wood were bonded together in a lamination resulting in plywood strengths far exceeding the sum total of the strengths of the individual layers. In the case of PVC laminations, it has been common practice in the prior art to sandwich a layer of synthetic fiber typically referred to as "scrim" between two PVC layers. An example of such a synthetic fiber sandwich known in the prior art includes a layer of polyester placed between two layers of PVC sheeting. The sandwich was then bonded together thermally and/or with an adhesive solution. Various lamination wall thicknesses with varying strengths could be achieved by varying the thicknesses of the PVC sheets and/or by varying the per square inch thread count of the scrim.

In the prior art, if (a) the single-ply PVC liner sheet is calendered thicker, or (b) the thickness of the PVC lamination is increased, unnecessarily high costs of materials are experienced if the increased thickness is applied to the entire sidewall. The strength required in the pool liner to offset the stress and strain of the water pressure is only required in the lower portion of the pool liner where the water pressure is the greatest. Consequently, if the increased thickness of materials is applied to the entire pool sidewall, the pool liner could be constructed to have a higher level of strength in the upper portion thereof then is necessary. This design of prior art pool liners can result in excessively high cost.

References describing flexible swimming pools of the prior art refer to single flexible plastic sheet components as being "united". In the prior art, "united" components or sections enable the flexible pool apparatus to be assembled. The "united" portions are typically known in the prior art as a "joining seam". These "joining seams" are typically formed on relatively low power machines for this purpose (for example, ten kilowatt peak load having low pressure in pounds per square inch (psi) applied to PVC sheeting). Consequently, lower bonding heat is generated and less pressure is applied to the PVC sheeting materials so that all of the air gaps between the PVC sheet materials are not eliminated. The end result of this process produces a low power bond suitable for joining seams in products comprised of flexible PVC sheeting which do not require high strength seams or joints. Joining seams are low strength conventional seams known in the art and serve to join two or more plastic PVC pieces together. The bonding can be accomplished by the use of thermal, radio frequency (dielectric), ultrasonic and adhesive methods. In the thermal method, heat is employed to join (i.e., melt) the PVC sheeting components together. In the radio frequency or dielectric method, friction in the form of kinetic energy is generated within the PVC sheet materials that creates the bond. In the ultrasonic method, sound waves also create kinetic energy that enable the molecules of the two PVC sheets to marry together. Finally, use of adhesives serve to mechanically bond the two PVC sheets together.

Certain prior art patent references will be mentioned including U.S. Pat. No. 2,529,872 to Hasselquist, U.S. Pat. No. 2,551,673 to Hasselquist, and U.S. Pat. No. 1,961,061 to McCulloch. None of these patent references are directed to a large capacity swimming pool capable of containing a high volume of water. U.S. Pat. No. 2,529,872 to Hasselquist entitled Collapsible Container is prior art which specifically refers to portable wading pools, portable baths, wash tubs, and stock watering tanks. The single seals disclosed in Hasselquist '872 are conventional "joining seams" located at separate locations. Seam 22 functions as a single conventional joining seam to connect the sidewall to the bottom piece. Seam 23 serves as a single conventional joining seam that forms the closure of an air chamber. Seams 15, 28 and 38 are also single conventional seams (in different embodiments) to serve to close an air chamber 16, 26 or 41. Each of these single conventional seams are located in different locations and assist in the assembly of the collapsible container. They do not serve a reinforcing function. The air chamber 16, 26 or 41 includes a vent 27 for trapping, not injecting, air therein. The drawing Figs. accompanying the '872 patent specification illustrate two small children standing in a small child's wading pool that has been filled by using a garden hose.

U.S. Pat. No. 2,551,673 to Hasselquist entitled Collapsible Container is prior art which also specifically refers to portable wading pools, portable storage tanks, baths, wash tubs, and stock watering tanks and containers. The '673 patent specifically refers to providing improvements in the Hasselquist '872 patent and thus discloses only single conventional joining seams for enabling the assembly of the wading pool. The joining seams are separated and are not used in any reinforcing capacity, for example, bottom circumferential seam 11. An annular sidewall 12 exhibits a double-walled construction and thus any reinforcing is provided by multiple full layers of material and not a reinforcing layer in combination with a plurality of reinforcing seals. The drawings accompanying the Hasselquist '673 patent also illustrate a small child's wading pool.

U.S. Pat. No. 1,961,061 to McCulloch entitled Collapsible Bathing Pool is prior art which specifically recites containers for water of a collapsible and portable nature. The different sections of water holding material are described as being "suitable united" which clearly indicates that the pool is assembled with single conventional "joining seams". A plurality of reinforcing seals is not disclosed. A reinforcement of the sidewall is disclosed as being integral with one or more thicknesses of material from which the sidewalls are made. The reinforcement essentially is a separate sidewall layer, not a continuous reinforcing layer or strip including a plurality of reinforcing seals.

Thus, there is a need in the art for a large capacity reinforced swimming pool which exhibits a lamination-to-lamination bond about the horizontal perimeter of the pool which includes a continuous reinforcing layer and a first and second plurality of reinforcing seals which significantly improves the strength of the sidewall of the swimming pool against failure or bursting, while simultaneously providing a thin-walled, lightweight, robust, durable, flexible construction suitable for above-the-ground large capacity swimming pools containing a high volume of water.

SUMMARY OF THE INVENTION

Briefly, and in general terms, the present invention provides a new and improved large capacity reinforced swimming pool for use in the above-the-ground environment which includes a continuous reinforcing layer in combination with a first plurality of continuous reinforcing seals and additionally a second plurality of continuous reinforcing seals, each for reinforcing a continuous sidewall and for preventing the failure thereof due to excessive water pressure in a lower half of the large capacity reinforced swimming pool.

In a preferred embodiment, the large capacity reinforced swimming pool includes a flexible liner typically comprised of a suitable plastic such as polyvinylchloride (PVC) sheeting for containing a fluid such as water. The plastic liner is typically circular in shape but can also exhibit other shapes including a rectangular shape. The plastic liner includes a continuous sidewall and a single-ply bottom wall fused to the sidewall with a joining seam. In the preferred embodiment, the continuous sidewall is formed from a partial outer layer and a partial inner layer. Mounted on top of the flexible liner via a joining seam is an inflatable top ring that when charged with air causes the plastic liner to be supported in an upright position when the pool is filled with water.

In the present invention, the continuous sidewall is reinforced to counter the pressure applied to the sidewall of the plastic liner by the static and dynamic pressure of the water in the large capacity reinforced swimming pool. In order to accomplish this goal, the sidewall includes a separate continuous reinforcing layer bonded to the continuous sidewall via a first plurality of continuous reinforcing seals. To further increase the reinforcement, the continuous sidewall also includes a second plurality of continuous reinforcing seals which are located between the partial outer layer and the partial inner layer of the sidewall. The bottom wall is separately attached to the continuous sidewall at an interface between the partial inner layer of the continuous sidewall and the bottom wall by a joining seam.

The present invention is generally directed to an above-the-ground, large capacity reinforced swimming pool for use in the out-of-doors. The inventive large capacity reinforced swimming pool provides an attractive and economical solution to an otherwise persistent problem. The reinforcing components need only be applied to a lower half of the swimming pool where the pressure applied to the sidewall from the water is the greatest. Further, the reinforcing scheme utilized, i.e., the width of the continuous reinforcing seals, can be varied depending upon the size and water volume capacity of the pool. In its most fundamental embodiment, the large capacity reinforced swimming pool includes a flexible plastic liner for containing water. The liner includes a continuous sidewall and a bottom wall bonded to the sidewall by a joining seam. The continuous sidewall is formed from a partial outer layer and a partial inner layer. An inflatable top ring is mounted to the top of the sidewall for supporting the liner in an upright position. A continuous reinforcing layer is bonded to the continuous sidewall with a first plurality of continuous reinforcing seals for reinforcing the sidewall. A second plurality of continuous reinforcing seals located at an interface between the partial outer layer and the partial inner layer of the sidewall function to reinforce the sidewall. Each of the first and second plurality of reinforcing seals comprise at least two seals.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 3 is a top planar view of the bottom wall of the large capacity reinforced swimming pool of FIG. 1 showing a plurality of sections intended to provide reinforcing to the bottom portion of the large capacity reinforced swimming pool.

FIG. 4 is a cross-sectional view of the large capacity reinforced swimming pool of FIG. 1 taken along the line 4—4 of FIG. 2 and showing a conventional joint seam for joining the partial outer layer and the partial inner layer of the continuous sidewall, and showing the second plurality of continuous reinforcing seals placed in juxtaposition to the conventional joint seam.

FIG. 5 is another cross-sectional view of the large capacity reinforced swimming pool of FIG. 1 taken along the line 5—5 of FIG. 2 and showing the continuous reinforcing layer which includes the first plurality of continuous reinforcing seals with each adjacent pair of reinforcing seals separated by a gap of unsealed polyvinylchloride material.

DESCRIPTION OF THE INVENTION

Figure 1:
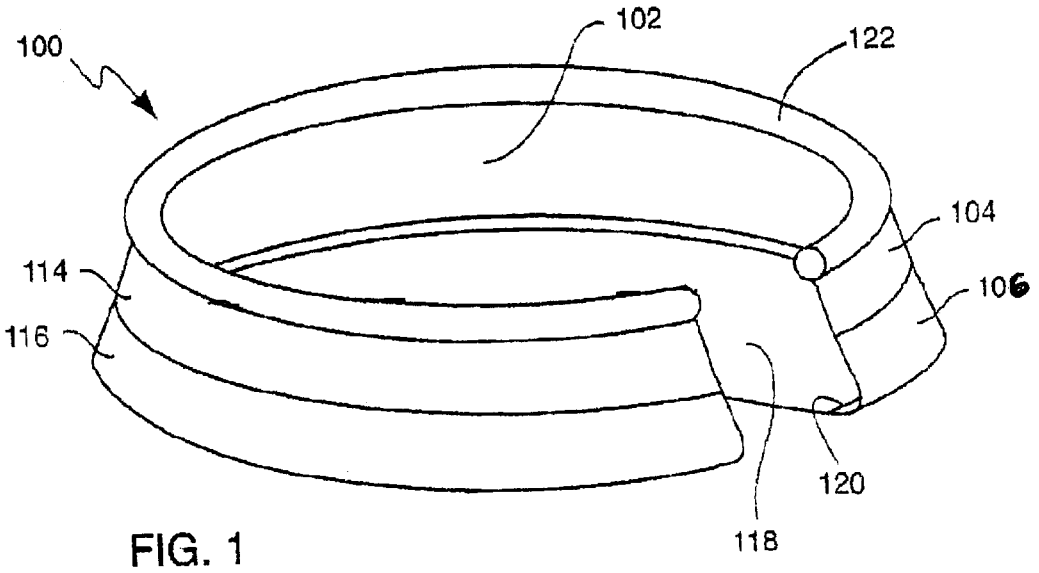
FIG. 1 is a perspective view including a cutaway portion of a large capacity reinforced swimming pool of the present invention having a flexible plastic liner and an inflatable top ring for causing the swimming pool to remain in the upright position.

The present invention is a large capacity reinforced swimming pool 100 having a minimum of a twelve foot diameter and a minimum water volume capacity of one-thousand U.S. gallons. Typically, the diameter of and the water volume capacity of the large capacity reinforced swimming pool 100 is greater. The large capacity reinforced swimming pool 100 is designed to accommodate several persons.

A preferred embodiment of the present invention of the large capacity reinforced swimming pool 100 is illustrated in FIGS. 1–5 herein. The large capacity reinforced swimming pool 100 includes a flexible plastic liner 102 having a continuous sidewall 104 as is clearly illustrated in FIG. 2. The reinforcing of the continuous sidewall 104 of the flexible plastic liner 102 is necessary to enable the sidewall 104 to withstand the static and dynamic pressure applied by the water to a lower portion 106 of the large capacity reinforced swimming pool 100.

In general, the reinforcing of the large capacity reinforced swimming pool 100 results from (a) bonding a continuous reinforcing layer 108 to the continuous sidewall 104 with a first plurality of continuous reinforcing seals 110, and (b) bonding a second plurality of continuous reinforcing seals 112 located at an interface between a partial outer layer 114 and a partial inner layer 116 of the continuous sidewall 104. The continuous reinforcing layer 108, the first plurality of continuous reinforcing seals 110, and the second plurality of continuous reinforcing seals 112 are each applied in a continuous horizontal fashion around the circumference of the large capacity reinforced swimming pool 100. This novel construction functions to strengthen the continuous sidewall 104 of the flexible plastic liner 102 to counter the pressure applied by the large volume of water to the lower portion 106 of the large capacity reinforced swimming pool 100.

Figure 2:
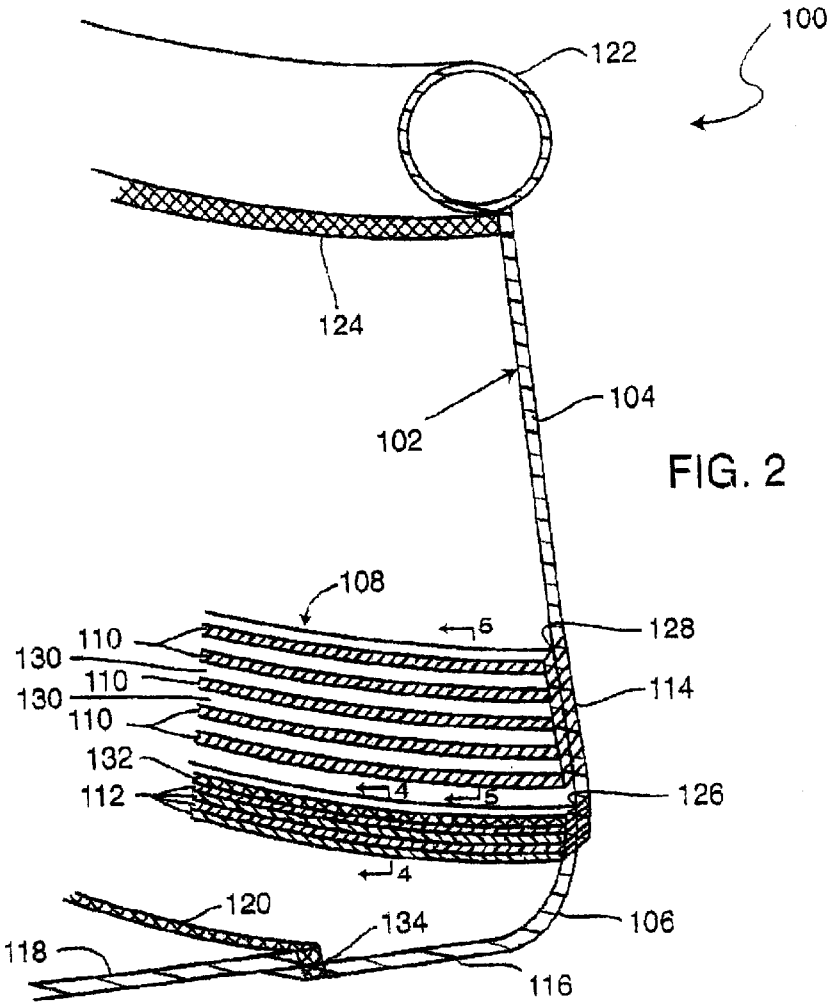
FIG. 2 is an end view in perspective of the large capacity reinforced swimming pool of FIG. 1 showing the detail of the cutaway portion including the inflatable top ring, a continuous sidewall having a partial outer layer and a partial inner layer, a continuous reinforcing layer having a first plurality of continuous reinforcing seals, a second plurality of continuous reinforcing seals, and a bottom wall.

As shown in FIGS. 1 and 2, the flexible plastic liner 102 is comprised of polyvinylchloride (PVC) sheeting and includes a bottom wall 118 in addition to the continuous sidewall 104. The bottom layer 118 is typically comprised of a sixteen gauge single-ply layer of PVC sheet material since the stress and strain of the water load is very low on the bottom of the large capacity reinforced swimming pool 100. The continuous sidewall 104 includes the partial outer layer 114 and the partial inner layer 116 as is best shown in FIG. 2. The bottom wall 118, which can have any shape including a circular shape as shown in FIG. 1, is bonded to the partial inner layer 116 of the continuous sidewall 104 in any suitable manner such as with a conventional joining seam 120 to provide a leakproof construction. Mounted on and bonded to the top of the continuous sidewall 104 of the flexible plastic liner 102 is an inflatable top ring 122. The mounting and bonding of the inflatable top ring 122 to the top of the continuous sidewall 104 can be accomplished by utilizing a conventional joining seam 124 as shown in FIG. 2. The inflatable top ring 122 serves to support the continuous sidewall 104 when the large capacity reinforced swimming pool 100 is filled with water. The inflatable top ring 122 is a continuous tube, i.e., one continuous chamber closed upon itself, comprised of plastic vinyl and having a single air injection port (not shown). In particular, when the inflatable top ring 122 is charged with air and the large capacity reinforced swimming pool 100 is filled with water, the top ring 122 (now inflated) causes the flexible plastic liner 102 to be supported in an upright position as is best shown in FIG. 1.

We now turn our attention to a more detailed description of the combination of components employed in the preferred embodiment of the large capacity reinforced swimming pool 100 best shown in FIG. 2. The large capacity reinforcing swimming pool 100 of the present invention is shaped to resemble essentially a round bag in the uninflated state. Consequently, the illustrations shown in FIGS. 1–5 are intended to exhibit the large capacity reinforced swimming pool 100 in the inflated state. The inflatable top ring 122 is shown mounted above and bonded to the partial outer layer 114 of the continuous sidewall 104 via the conventional joining seam 124. The partial outer layer 114 of the continuous sidewall 104 extends immediately below the inflatable top ring 122 and downward to an interface 126 of the partial outer layer 114 and the partial inner layer 116. Both the partial outer layer 114 and the partial inner layer 116 are each a lamination and comprised of a 28 gauge three-ply sandwich. The three-ply sandwich includes two outer layers of Polyvinylchloride (PVC) sheeting and a middle layer comprised of a woven fabric such as nylon or polyester mesh. The woven fabric provides strength to both the partial outer layer 114 and the partial inner layer 116.

Both the continuous sidewall 104 and the bottom wall 118 are comprised of a plurality of polyvinylchloride (PVC) sections that are bonded together by conventional joining seams. These "joining seams" are typically formed on relatively low power machines (for example, ten kilowatt peak load having low pressure in pounds per square inch (psi) applied to PVC sheeting) for bonding PVC sheet components together. Consequently, lower bonding heat is generated and less pressure is applied to the PVC sheet materials so that all of the air gaps between the PVC sheet materials are not eliminated. The end result of this process produces a low power bond suitable for joining seams in products comprised of flexible PVC sheeting which do not require high strength seams or joints.

Joining seams are low strength conventional seams known in the art and serve to join two or more plastic PVC pieces together. The bonding can be accomplished by the use of thermal, radio frequency (dielectric), ultrasonic and adhesive methods. In the thermal method, heat is employed to join (i.e., melt) the PVC sheeting components together. In the radio frequency or dielectric method, friction is generated within the PVC sheeting materials that creates the bond. In the ultrasonic method, sound waves create kinetic energy that enable the molecules of the two PVC sheets to marry together. Finally, use of adhesives serve to mechanically bond the two PVC sheets together.

When the large capacity reinforced swimming pool 100 is filled with water, the static and dynamic pressure created by the water places much stress and strain on the flexible plastic liner 102 and particularly on the continuous sidewall 104 and the conventional joining seams that bond these components together. The high stress/strain load caused by the static and dynamic pressure of the water load is particularly evident in the lower portion 106 of the large capacity reinforced swimming pool 100. This pressure is indicated in FIGS. 1 and 2 by a bulge appearing in the lower portion 106 of the large capacity reinforced swimming pool 100. In order to counter this situation and to avoid leaks and bursting of the conventional joining seams, the bottom portion 106 of the flexible plastic liner 102 is reinforced in the present invention.

The preferred embodiment of the present invention includes (a) the continuous reinforcing layer 108 in combination with (b) the first plurality of continuous reinforcing seals 110, and further includes (c) the second plurality of continuous reinforcing seals 112 as the reinforcing components. The continuous reinforcing layer 108 in combination with the first plurality of continuous reinforcing seals 110 function to increase the strength of the continuous sidewall 104 and are clearly illustrated in FIG. 2. The continuous reinforcing layer 108 is actually a separate layer of, for example, a 28 gauge three-ply laminate comprised of an inner and outer layer of Polyvinylchloride (PVC) sheeting and a middle layer of a woven fabric such as nylon or a polyester mesh. Thus, the continuous reinforcing layer 108 is comprised of the same or comparable PVC sheet materials as that of the flexible plastic liner 102. The continuous reinforcing layer 108 and the partial outer layer 114 meet at an interface 128 as shown in FIG. 2. The continuous reinforcing layer 108 is shown in FIG. 2 as bonded to the inside of the continuous sidewall 104 with the first plurality of continuous reinforcing seals 110. However, it is noted that the continuous reinforcing layer 108 can also be bonded to the exterior of the continuous sidewall 104 to serve the same reinforcing function.

The continuous reinforcing layer 108 which is bonded to the 28 gauge three-ply partial outer layer 114 is illustrated in FIG. 5. These sandwiched layers exhibit a double laminate (i.e., two three-ply laminates) which provides for a double wall construction in cross-section as shown in FIG. 2. In the preferred embodiment, the continuous reinforcing layer 108 is bonded to the partial outer layer 114 via the first plurality of continuous reinforcing seals 110. As an example and not by way of limitation, the first plurality of continuous reinforcing seals 110 includes five non-contiguous seals 110 as shown in FIG. 5. The number of reinforcing seals 110 can vary depending upon the diameter and the water volume capacity of the large capacity reinforced swimming pool 110. A separation or "gap" 130 is shown between each of the five non-contiguous seals 110 where each gap 130 represents a portion of the 28 gauge laminate layer that forms the continuous reinforcing layer 108.

In the example illustrated in FIG. 5, the double wall construction includes five continuous reinforcing seals 110 and four separations or gaps 130. The four separations or gaps 130 positioned between each of the five continuous reinforcing seals 110 enables the continuous reinforcing layer 108 to be flexible in response to the static and dynamic pressure applied by the water load. The first plurality of continuous reinforcing seals 110 are referred to as being continuous because they close upon themselves in the closed perimeter large capacity reinforced swimming pool 100. This feature is illustrated in FIG. 2 by showing the first plurality of continuous reinforcing seals 110 extending beyond the interface 128. It has been determined that to prevent failure of the continuous sidewall 104 due to the stress and strain of the water load, the first plurality of continuous reinforcing seals 110 must comprise at least three seals each having a width of one-half inch, or at least two seals each having a width of three-quarters of an inch.

The partial outer layer 114 and the partial inner layer 116 meet at the interface 126 as shown in FIG. 2. The interface 126 includes a double lamination comprised of a conventional joining seam 132 and the second plurality of continuous reinforcing seals 112 best shown in FIG. 2. The joining seam 132 is the conventional method utilized to assemble the partial outer layer 114 to the partial inner layer 116 as is known in the art. The second plurality of continuous reinforcing seals 112 are contiguous, i.e., side-by-side, and do not include the gaps 130 of PVC material (representing a portion of the 28 gauge laminate layer that forms the continuous reinforcing layer 108) positioned between each of the first plurality of continuous reinforcing seals 110. Also, when one of the second plurality of continuous reinforcing seals 112 is placed adjacent to the conventional joining seam 132, they are also contiguously spaced, i.e., side-by-side. This design exists to ensure the integrity of the conventional joining seam 132 and to improve the overall strength of the interface 126. The second plurality of continuous reinforcing seals 112 are comprised of the same or comparable PVC sheet materials as that of the flexible plastic liner 102.

The second plurality of continuous reinforcing seals 112 are referred to as being continuous because they close upon themselves in the closed perimeter large capacity reinforced swimming pool 100. This feature is illustrated in FIG. 2 by showing the second plurality of continuous reinforcing seals 112 extending beyond the interface 126. The dies utilized in forming each of the second plurality of continuous reinforcing seals 112 form a flat seal with a thin ridge of the double lamination (six-ply sandwich material) extending upward between each of the continuous reinforcing seals 112. The double lamination of the interface 126 comprises two of the 28 gauge three-ply sandwiches placed in juxtaposition. Thus, the second plurality of continuous reinforcing seals 112 significantly increases the strength of the flexible plastic liner 102 at the interface 126 to resist bursting of the continuous sidewall 104.

It has also been determined that to prevent failure of the continuous sidewall 104 due to the stress and strain of the water load, the second plurality of continuous reinforcing seals 112 must comprise at least three seals each having a width of one-half inch, or at least two seals each having a width of three-quarters of an inch. It is also noted that due to economics, each of the seals of the first and second pluralities of continuous reinforcing seals 110 and 112 are either one-half inch in width or three-quarters of an inch in width. Thus, the width of the continuous reinforcing seals 110 and 112 are not intermixed in the same large capacity reinforced swimming pool 100. Further, the cross-over from one-half inch reinforcing seals to three-quarter inch reinforcing seals typically occurs when the vertical height of the large capacity reinforced swimming pool 100 is 42 inches or above.

We now turn to a description of the character, nature, features and structure of the first plurality of continuous reinforcing seals 110 and the second plurality of continuous reinforcing seals 112 and how they distinguish over the conventional joining seam. Prior art convention joining seams are typically formed on relatively low power machines (for example, ten kilowatt peak load having low pressure in pounds per square inch (psi) applied to PVC sheeting) for bonding PVC sheet components together. Consequently, lower bonding heat is generated and less pressure is applied to the PVC sheet materials so that all of the air gaps between the PVC sheet materials are not eliminated. This process produces a bond suitable for joining seams in products comprised of flexible PVC sheeting which do not require high strength seams or joints. The process utilized in the present invention for forming the continuous reinforcing seals 110 and 112 serves to produce a high strength bond between PVC sheeting materials for reinforcing the large capacity reinforced swimming pool 100.

In the present invention, the first plurality of continuous reinforcing seals 110 and the second plurality of continuous reinforcing seals 112 are formed in continuous loops that surround the circumference of the large capacity reinforcing swimming pool 100. The continuous loops of the reinforcing seals 110 and 112 are formed of the same PVC materials as that of the flexible plastic liner 102 in integral units of eight inches or larger. These sections are referred to as eight inch welds. Thus, each eight inch section is connected or welded to the adjacent eight inch section to form the continuous reinforcing seals 110 and 112 which form a complete horizontal loop around the circumference of the large capacity reinforced swimming pool 100.

The first plurality of continuous reinforcing seals 110 and the second plurality of continuous reinforcing seals 112 are formed by a higher power plastic sealing machine (not shown) rated at twenty-five kilowatts (25 kW). The higher power plastic sealing machine operates at higher electric parameters (i.e., three phase electric voltage and current) and thus generates more heat and applies a greater pressure to the PVC sheets for providing a higher integrity bond between PVC sheets. Increased heat generation provides for a higher level of thermal bonding and increased pressure in pounds per square inch (psi) applied to the PVC sheets eliminates most air gaps which reduces the probability of failure of the bond when subjected to the water load in the large capacity reinforced swimming pool 100. Consequently, the first plurality of continuous reinforcing seals 110 and the second plurality of continuous reinforcing seals 112 each comprise a high voltage, high pressure seal for PVC sheet materials.

Further, this procedure results in tighter bonding to further enhance the integrity of the reinforcing seals 110 and 112 to account for the peaks and valleys inherent in the sheets of PVC plastic. Thus, the quality and strength of the continuous reinforcing seals 110 and 112 are enhanced far beyond that of conventional joining seams which exhibit a lower level of thermal bonding and air gap elimination. These are the reasons why the first plurality of continuous reinforcing seals 110 and the second plurality of continuous reinforcing seals 112 are reinforcing and stronger and distinguishable from multiple conventional joining seams. Thus, the new and unexpected result occurring from the inclusion of the first plurality of continuous reinforcing seals 110 and the second plurality of continuous reinforcing seals 112 into the present invention is the low failure rate of the continuous reinforcing seals 110 and 112 formed in the continuous sidewall 104 of the flexible plastic liner 102.

The partial inner layer 116 extends downward from the interface 126 of the continuous sidewall 104 as is shown in FIG. 2. The 28 gauge three-ply sandwich of the partial inner layer 116 then meets the bottom wall 118 at an interface 134. The bottom wall 118 is a 16 gauge single-ply layer of Polyvinylchloride (PVC) sheeting. The bottom wall 118, which can have any shape including a circular shape as shown in FIG. 1, is bonded to the partial inner layer 116 of the continuous sidewall 104 at the interface 134 in any suitable manner such as with the conventional joining seam 120 to provide a leakproof construction. As is shown in FIG. 2, the conventional joining seam 120 tracks the inner circumference of the large capacity reinforced swimming pool 100.

FIG. 3 exhibits a top planar view of a bottom ring 140 of the large capacity reinforced swimming pool 100 of the present invention. The bottom ring 140 is comprised of an outer circle 142 and an inner concentric circle 144. The area between the outer circle 142 and the inner concentric circle 144 is divided into, for example, fifteen sections by a plurality of radial segments 146. The outer circle 142 shown in FIG. 3 represents the second plurality of continuous reinforcing seals 112 as shown in FIG. 2. Likewise, the inner concentric circle 144 represents the conventional joining seam 120 also shown in FIG. 2. Additionally, each of the fifteen radial segments 146 shown in FIG. 3 represents the length of the 28 gauge three-ply partial inner layer 116 shown in FIG. 2. The center of the inner concentric circle 144 is the bottom wall 118.

The bottom ring 140 illustrated in FIG. 3 functions to provide a stiffer bottom to the flexible plastic liner 102 in the area between the second plurality of continuous reinforcing seals 112 and the conventional joining seal 120, i.e., the partial inner layer 116. This is the case since the partial inner layer 116 is a 28 gauge three-ply laminate which is significantly more robust than the 16 gauge single-ply Polyvinylchloride (PVC) sheeting layer of the bottom wall 118. Additionally, the bottom ring 140 represented by the area between the second plurality of continuous reinforcing seals 112 and the conventional joining seam 120 is substantially planar as shown in FIGS. 2 and 3.

The area between the outer circle 142 and the inner concentric circle 144 of FIG. 3 is divided into, for example, fifteen radial segments 146 because the full bottom ring 140 cannot be fabricated from a single piece of laminate. This is the case since the calendering and laminating equipment is limited as to how wide a bottom ring 140 can be fabricated at one time. Consequently, the bottom ring 140 is fabricated in pieces. In larger reinforced swimming pools 100, additional radial segments 146 can be employed. Additionally, fabricating the bottom ring 140 from the radial segments 146 improves the strength of the bottom ring 140 and is more economical since the best use is made of material scraps resulting in minimal waste.

During the conception and reduction to practice phases of the present invention, applicants engaged in the design, development and testing of the large capacity reinforced swimming pool 100 having the flexible plastic liner 102. One of the objectives of the applicants' was to develop seams in the flexible plastic liner 102 that would not shear, rupture or fail under either dynamic or static conditions in pools having a water depth of from 36 inches-to-52 inches. During the design phase, the teachings of (a) Pascal's Principle (i.e., the pressure in a static fluid is the same in all directions), and (b) Hooke's Law (i.e., within the elastic limit, deformation produced is proportional to the stress), and (c) Young's Modulus (i.e., modulus of elasticity in tension) were consulted and relied upon. After preliminary calculations concerning the parameters of the large capacity reinforced swimming pool 100 were completed, it was determined that the multiple continuous seals 110 and 112 were required to reinforce the conventional joining seams 132 of the flexible plastic liner 102 against failure.

During the testing phase, several combinations of the continuous reinforcing seals 110 and 112 were tested to determine when the conventional joining seams 132 would fail. The test results verified that (1) at least three seals each having a width of one-half inch, or (2) at least two seals each having a width of three-quarters of an inch were required to provide adequate strength against failure of the conventional joining seams 132 of the flexible plastic liner 102. The test results also verified that the actual number of the continuous reinforcing seals 110 and 112 required to provide adequate strength against failure of the conventional joining seams 132 of the flexible plastic liner 102 is dependent upon the depth of the water in the large capacity reinforced swimming pool 100.

It was discovered that the present invention for the large capacity reinforced swimming pool 100 that applies the first and second pluralities of continuous reinforcing seals 110 and 112 to the conventional seams 132 of the flexible plastic liner 102 provided adequate strength to the conventional seams 132 against failure not only under static water conditions but also under dynamic water stress conditions superimposed upon the static water stresses. Consequently, our test results verified that use of the first and second pluralities of continuous reinforcing seals 110 and 112 in the design of the large capacity reinforced swimming pool 100 enabled the conventional joining seams 132 of the flexible plastic liner 102 to avoid failure as the depth of the water in the large capacity reinforced swimming pool 100 increases.

The following engineering data was employed in the design and development of the present invention. All references to specific engineering concepts, principles and laws were obtained from Marks' STANDARD HANDBOOK FOR MECHANICAL ENGINEERS, Eighth Edition, pages 3–37 and 5–18, Copyright 1978 by McGraw-Hill, Inc., Copyright renewed 1979 by Lionel P. Marks and Alison P. Marks. At the time of the present invention, the inventors were engaged in the designing, developing and testing of the large capacity reinforced inflatable swimming pool 100 having the flexible plastic liner 102. Single conventional joining seams 132 employed at stress locations in inflatable swimming pools would rapidly fail when the depth of the pool increased. The objective was to develop seams in the plastic liner 102 of the large capacity reinforced swimming pool 100 that would not shear, rupture or fail under static water stress conditions or dynamic water stress conditions (i.e., water motion) in inflatable swimming pools having a water depth of from 36 inches-to-52 inches.

As applied to large capacity inflatable swimming pools having a depth of from 36 inches-to-52 inches, the following data applies:

(1) a pool having a 12' diameter and 30" height filed to 80% capacity has a water volume is 1353 gallons which weighs in excess of 11,200 lbs.;

(2) a pool having a 15' diameter and 36" height filed to 80% capacity has a water volume is 2561 gallons which weighs in excess of 21,200 lbs.;

(3) a pool having a 15' diameter and 42" height filed to 80% capacity has a water volume is 3110 gallons which weighs in excess of 25,700 lbs.;

(4) a pool having an 18' diameter and 36" height filed to 80% capacity has a water volume is 3735 gallons which weighs in excess of 30,900 lbs.; and (5) a pool having an 18' diameter and 42" height filed to 80% capacity has a water volume is 4814 gallons which weighs in excess of 39,900 lbs.

The weight of the water in each of these example pools has been calculated by knowing (a) the water volume of each inflatable pool (at 80% capacity), and (b) knowing that one cubic foot of water is approximately equivalent to 7.48 U.S. gallons and weighs approximately 8.3 lbs. [Data available from CRC Standard Mathematical Tables, $18^{th}$ Edition, Copyright 1970 by The Chemical Rubber Company, Cleveland, Ohio.]

Clearly, the volume of water and corresponding weight ranging from 11,200 lbs.-to-39,900 lbs. during static water stress conditions results in an enormous lateral force component applied to the sidewall of the flexible plastic liner. When people are playing in the pool, dynamic water stress conditions are superimposed upon the static water stress conditions. Consequently, the sidewall must be reinforced to withstand the huge weight of the water.

Certain fundamental principles of mechanical engineering were employed by Applicants during the development of the present invention.

(1) Pascal's principle teaches that the pressure in a static fluid is the same in all directions.

(2) The pressure-height relations for a fluid teaches that the pressure increases as a function of the depth of the fluid in the pool, and that the greatest stresses are applied at the bottom of the pool. This simplifies the basic equation for fluid statics.

(3) Next, Elasticity is the ability of a material to return to its original dimensions after the removal of stresses.

(4) Hooke's Law states that, within the elastic limit, deformation produced is proportional to the stress. Since the greatest stress is at the greatest depth, the bottom portion 106 of the pool 100 will stretch the most and thus requires substantial reinforcing to withstand the stress.

(5) Finally, the Modulus of Elasticity is the ratio of the increment of unit stress to increment of unit deformation within the elastic limit where the Modulus of Elasticity in tension is Young's Modulus.

The test results conducted by Applicants substantiated that (1) at least three seals each having a width of one-half inch, or (2) at least two seals each having a width of three-quarters of an inch were required to provide adequate strength against failure of the conventional joining seams 132 of the flexible plastic liner 102. The test results also verified that the actual number of the continuous reinforcing seals 110 and 112 required to provide adequate strength against failure of the conventional joining seams 132 of the flexible plastic liner 102 is dependent upon the depth of the water in the large capacity reinforced swimming pool 100.

The present invention provides novel advantages over other reinforcing methods applied to swimming pools known in the prior art. The present invention is an attractive and economical solution to an otherwise persistent leakage problem caused by water pressure applied to the joining seams in above-the-ground type swimming pools. Water pressure applied against the continuous sidewall 104 of the large capacity reinforced swimming pool 100 is greatest in the bottom portion 106 thereof. Therefore, a main advantage of the large capacity reinforced swimming pool 100 of the present invention is that the continuous reinforcing layer 108 bonded to the continuous sidewall 104 via the first plurality of continuous reinforcing seals 110, and additionally the second plurality of continuous reinforcing seals 112 need only be added to the bottom portion 106 of the large capacity reinforced swimming pool 100. The water volume capacity and the vertical height of the continuous sidewall 104 determine the width of the first plurality of continuous reinforcing seals 110 and the width of the second plurality of continuous reinforcing seals 112.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A large capacity reinforced swimming pool comprising:

a flexible plastic liner for containing water, said liner including a continuous sidewall and a bottom wall bonded to said sidewall with a joining seam;

an inflatable top ring mounted on said sidewall for supporting said liner in an upright position;

a continuous reinforcing layer bonded to said sidewall with a first plurality of continuous reinforcing seals for reinforcing said sidewall; and a second plurality of continuous reinforcing seals located at an interface between a partial outer layer and a partial inner layer of said sidewall for reinforcing said sidewall, each of said first plurality of reinforcing seals and each of said second plurality of reinforcing seals comprising at least three seals each having a width of one-half of an inch.

2. A large capacity reinforced swimming pool comprising:

a flexible plastic liner for containing water, said liner including a continuous sidewall and a bottom wall bonded to said sidewall with a joining seam;

an inflatable top ring mounted on said sidewall for supporting said liner in an upright position;

a continuous reinforcing layer bonded to said sidewall with a first plurality of continuous reinforcing seals for reinforcing said sidewall; and a second plurality of continuous reinforcing seals located at an interface between a partial outer layer and a partial inner layer of said sidewall for reinforcing said sidewall, each of said first plurality of reinforcing seals and each of said second plurality of reinforcing seals comprising at least two seals each having a width of three-quarters of an inch.

3. A large capacity reinforced swimming pool comprising:

a flexible plastic liner for containing water, said liner including a continuous sidewall and a bottom wall bonded to said sidewall with a joining seam;

an inflatable top ring mounted on said sidewall for supporting said liner in an upright position;

a continuous reinforcing layer bonded to said sidewall with a first plurality of continuous reinforcing seals for reinforcing said sidewall; and a second plurality of continuous reinforcing seals located at an interface between a partial outer layer and a partial inner layer of said sidewall for reinforcing said sidewall, each of said first plurality of reinforcing seals and each of said second plurality of reinforcing seals comprising at least two seals.

4. The large capacity reinforced swimming pool of claim 3 wherein said flexible plastic liner is comprised of polyvinylchloride sheeting.

5. The large capacity reinforced swimming pool of claim 3 wherein said continuous sidewall is a multi-ply wall comprised of polyvinylchloride sheeting and a woven nylon fabric.

6. The large capacity reinforced swimming pool of claim 3 wherein said continuous sidewall is a multi-ply wall comprised of polyvinylchloride sheeting and a polyester mesh.

7. The large capacity reinforced swimming pool of claim 3 wherein said bottom wall is a single-ply plastic wall.

8. The large capacity reinforced swimming pool of claim 3 wherein said reinforcing layer and each of said first plurality of reinforcing seals is comprised of polyvinylchloride sheeting.

9. The large capacity reinforced swimming pool of claim 3 wherein each of said second plurality of reinforcing seals is comprised of polyvinylchloride sheeting.

10. The large capacity reinforced swimming pool of claim 3 wherein said seals of said first plurality of reinforcing seals are non-contiguous.

11. The large capacity reinforced swimming pool of claim 3 wherein said reinforcing layer bonded to said continuous sidewall forms at least a double wall construction.

12. The large capacity reinforced swimming pool of claim 3 wherein said seals of said second plurality of reinforcing seals are contiguous.

13. The large capacity reinforced swimming pool of claim 3 wherein said first plurality of continuous reinforcing seals each comprise a high voltage, high pressure seal.

14. The large capacity reinforced swimming pool of claim 3 wherein said second plurality of continuous reinforcing seals each comprise a high voltage, high pressure seal.

* * * * *